US005277128A

United States Patent [19]

Zimmerle

[11] Patent Number: 5,277,128

[45] Date of Patent: Jan. 11, 1994

[54] RAILCAR GRAVITY MULTI-PLY OUTLET SEAL FOR SLIDING DOORS

[75] Inventor: James R. Zimmerle, St. Charles, Mo.

[73] Assignee: ACF Industries, Incorporated, Earth City, Mo.

[21] Appl. No.: 900,273

[22] Filed: Jun. 18, 1992

[51] Int. Cl.[5] ..... B61D 7/20; B61D 7/22

[52] U.S. Cl. ..... 105/282.2; 49/475.1

[58] Field of Search ..... 105/282.2; 49/475, 485

[56] References Cited

U.S. PATENT DOCUMENTS

| | | | |
|---|---|---|---|
| 3,472,178 | 10/1969 | Floehr | 105/282.1 |
| 3,807,318 | 4/1974 | Chierici | 105/282.2 |
| 4,528,913 | 7/1985 | Randolph | 105/282.2 |
| 4,538,380 | 9/1985 | Colliander | 49/475 |
| 4,667,966 | 5/1987 | Oehrle et al. | 49/475 X |
| 4,768,684 | 9/1988 | Dugge | 222/542 |
| 4,884,723 | 12/1989 | Dugge | 222/542 |

FOREIGN PATENT DOCUMENTS

| | | | |
|---|---|---|---|
| 534986 | 12/1956 | Canada | 105/282.2 |
| 1409441 | 10/1975 | United Kingdom | 49/475 |

*Primary Examiner*—Douglas C. Butler
*Assistant Examiner*—S. Joseph Morano
*Attorney, Agent, or Firm*—Polster, Lieder, Woodruff & Lucchesi

[57] ABSTRACT

A gravity outlet valve (10) is for use on a railway car for discharge of lading from the car. The valve has sloping sidesheets connected together to form sidewalls (12*a*, 12*b*) and endwalls (14*a*, 14*b*) of the valve. An outlet (O) is defined by the lower end of the sidesheets and endsheets. A gate (16) is located beneath the outlet and is slidably movable from a valve closed to a valve open position. A seal (34) is used for sealing the valve and preventing loss of lading. The seal is a multi-ply seal having an inner core (36) of a spring-like material, and an outer covering (38) of a wear resistant material. The outer covering is contacted by the gate as it moves between its positions. The inner core forces the outer covering into this contact whereby a seal is effected between the outer covering and the gate.

5 Claims, 2 Drawing Sheets

RAILCAR GRAVITY MULTI-PLY OUTLET SEAL FOR SLIDING DOORS

BACKGROUND OF THE INVENTION

This invention relates to gravity outlets for railroad cars and, more particularly, to a multi-ply seal for use on such outlets.

In railroad cars for transporting a lading, one way of discharging the lading is by use of gravity outlets. The car has a series of hopper sections in which the lading is transported, and an outlet is positioned at the bottom of each hopper section. The outlet includes a horizontally sliding gate which is movable to open the outlet and allow the lading to discharge from the car. Because of the metal construction of the outlet and its gate, the parts tend to wear. As they wear, and due to other distortions which occur over time, the gate and valve body do not always seat properly. This not only makes the outlet more difficult to open and close, but may also result in lading contamination, or lading being lost during transport.

SUMMARY OF THE INVENTION

Among the several objects of the present invention may be noted the provision of a sliding gate gravity outlet for discharging lading from a railway car; the provision of such an outlet to employ a seal extending about the opening in the outlet through which the lading discharges; the provision of such a seal to be a multi-ply seal; the provision of such a seal having as an inner ply a material which acts as a spring to maintain the seal in contact with the parts of the outlet; the provision of such a seal which has an outer ply of a wear resistant material to facilitate mating of the moving and stationary parts of the outlet; the provision of such a seal to improve the seating of an outlet gate thereby to prevent loss of lading during transport; and, the provision of such a seal which is low in cost, easy to install, and has a long service life.

In accordance with the invention, generally stated, a gravity outlet valve is for use on a railway car for discharge of lading from the car. The valve has sloping sidesheets connected together to form sidewalls of the valve. An outlet is defined at the lower end of the sidesheets. A gate is located beneath the outlet and is slidably movable from a valve closed to a valve open position. An improvement comprises a seal for sealing the valve and prevent loss of lading. The seal is a multi-ply seal having an inner core of a spring-like material, and an outer covering of a wear resistant material. The outer covering is contacted by the gate as it moves between its positions. The inner core forces the outer covering into this contact whereby a seal is effected between the outer covering and the gate. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
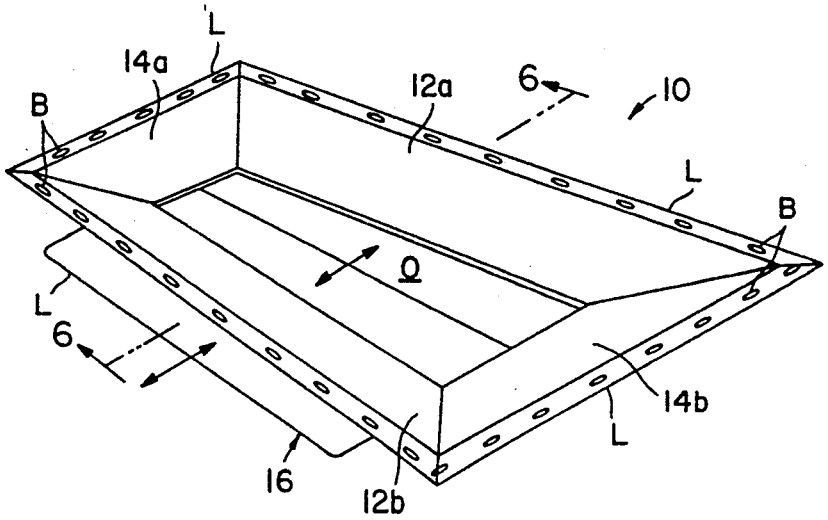
FIG. 1 is a perspective view of a sliding gate gravity outlet for discharging lading from a railway car.

Referring to the drawings, a gravity outlet 10 is for use on a railway car (not shown). As is well understood in the art, the car may have a hopper in which the lading is transported. An outlet is installed at the bottom of the hopper for discharge of lading from the car when it reaches its destination. Outlet 10 has respective sloping sidewalls 12*a*, 12*b*, and sloping endwalls 14*a*, 14*b*. Each sidewall or endwall is formed of a sheet of metal; steel, for example, which are joined together by welding. Each sheet has a lip L formed at its upper end, and each lip has a plurality of spaced openings, bolt holes B, for example, for attaching the outlet to the hopper by bolting it in place, for example. Other forms of attachment, e.g. welding, may also be used. Regardless, when the sheets of material are joined together, they define an outlet opening O at their lower end.

Figure 2:
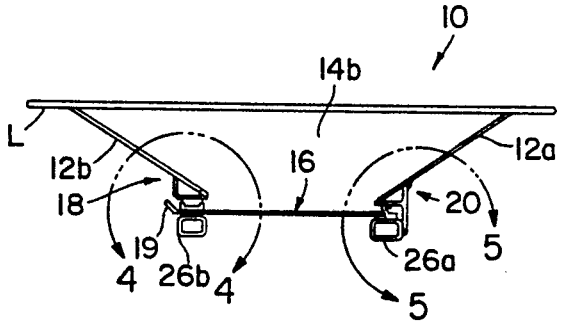
FIG. 2 is an end view of the outlet.
Figure 4:
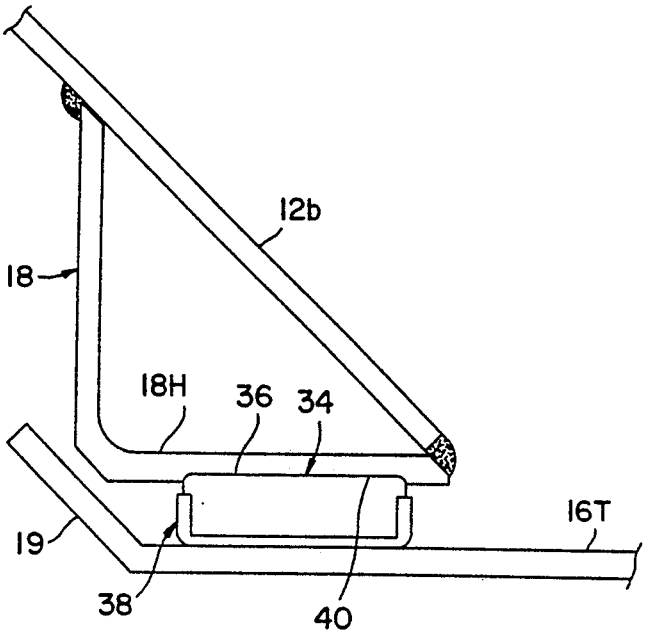
FIG. 4 is a sectional view of the seal taken along line 4—4 in FIG. 2.
Figure 6:
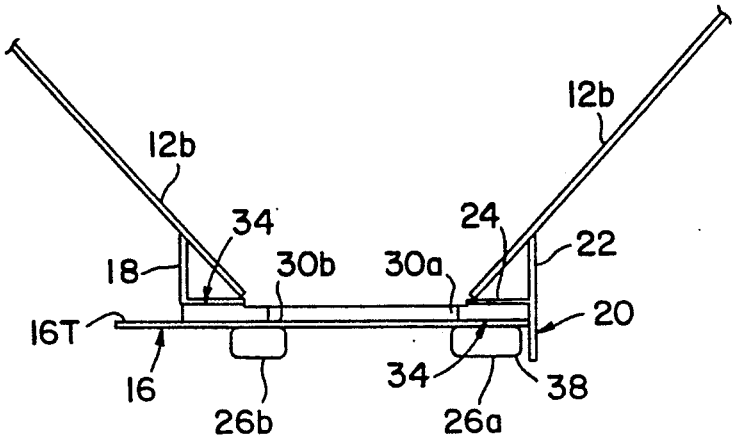

Referring to FIGS. 2 and 6, a gate 16 is mounted beneath opening O. Gate 16 is rectangular in plan and its dimension is such that it is longer and wider than the opening. The gate is slidably movable from an outlet closed position shown in FIG. 6 to an outlet open position shown in FIG. 1. For installing the gate in the outlet assembly, an L-shaped bracket 18 is attached, by welding, to the underside of sidewall sheet 12*b*. The ends of both arms of the bracket are attached to the underside of the sheet. The lower arm of the bracket is even with the lower end of the sidewall sheet. As shown in FIG. 1, plate 16 can be a flat plate. Or, as shown in FIG. 4, the outer end of the plate may have an upturned lip 19. If this so, the corner of bracket 18 may be beveled, as indicated at V, to accommodate the lip.

Similarly, a T-shaped bracket 20 is attached to the underside of sidewall sheet 12*a*. For bracket 20, one end of crossarm 22, and the base of bracket stem 24 are attached to the underside of the sheet. Stem 24 is attached to the sheet so it is even with the lower end of the sheet. This allows the other end of the crossarm to extend below the lower end of the sheet. This portion of the crossarm then acts a stop to limit movement of gate 16 when its is moved to its outlet closing position.

Figure 5:
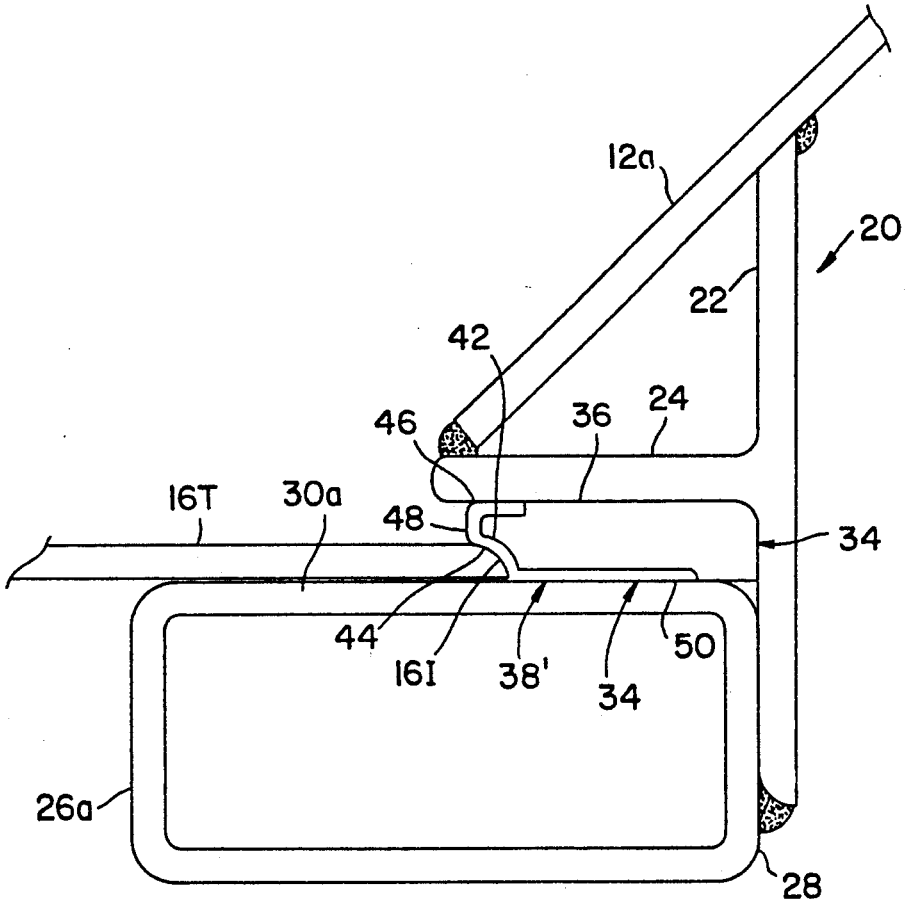
FIG. 5 is a sectional view of the outlet taken along line 5—5 in FIG. 2 and illustrating use of the seal with the outlet; and, FIG. 6 is a sectional view of the outlet taken along line 6—6 in FIG. 1.

Finally, a box-type beam or support 26*a*, 26*b* is positioned on either side of the outlet beneath the side sheets. The beams provide a lower support for gate 16. As seen in FIG. 5, the lower end of crossarm 22 of bracket 20 is attached to an outer face 28 of beam 26*a* by, for example, welding. When mounted in place, there is a spatial separation between the lower end of the side sheets and the respective upper faces 30*a*, 30*b* of the beams. The height of gate 16 is such that it slides through this space to open and close the outlet.

Figure 3:
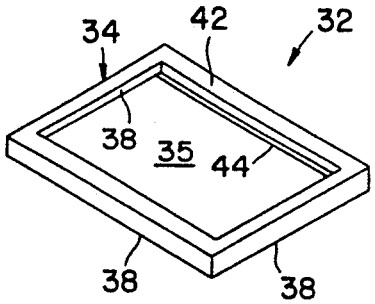
FIG. 3 is a perspective view of a seal of the present invention for use with the outlet.

A seal means 32 (see FIG. 3) is provided for sealing outlet O and preventing loss of lading. Sealing means 32 comprises a rectangular shaped seal 34 which extends completely around the periphery of opening O. Further, seal 34 has a central, rectangular opening 35 sized to be slightly larger than opening O. Seal 34 is a multi-ply seal having an inner core 36 of a spring-like material, and an outer covering 38 of a wear resistant material. As shown in FIGS. 4 and 5, this outer covering, which is a wear resistant rubber material, is contacted by gate 16 as it moves between its open and closed positions. As shown, the inner core forces the outer covering into contact with the gate thereby to effect a seal between the outer covering and the gate. The seal is generally rectangular in cross section.

With respect to FIG. 4, it will be seen that seal 34 is positioned so to rest between the underside of the horizontally extending leg 18H of bracket 18 and the top surface 16T of gate 16. The outer covering 38 of seal 34 is generally U-shaped along this side of the seal and fits down the sides and across the bottom of the inner core of the seal. This U-shaped covering also extends along both end sides of the seal. For installation purposes, The underside of bracket leg 18H may have a recess 40 in which the upper end of the seal fits. In any event, the inner core, acting in a spring-like fashion, bears against surface 16T. The wear resistant outer covering prevents particles of lading from working their way outwardly from the outlet; and, it also prevents dust, dirt, or other potential contaminants from being drawn into the outlet, by movement of the gate, and contaminating a lading.

The opposite side of the seal is shown in FIG. 5 to have an inner face or sidewall 42 against which the inner face 161 of the gate bears when the gate is in its outlet closing position. As shown, face 161 bears against the lower portion of seal face 42. To accommodate the inner end of the gate, seal face 42 has a groove 44 extending the length of this side of the seal. Groove 44 curves inwardly to match the curved inner end of the gate. For this side of the seal, the outer covering is not a U-shaped covering 38. Rather, this portion of the outer covering 38' has an upper lip 46 which extends outwardly over the top surface of inner core 36. The outer covering next has an outer face 48 which fits over the flat and curved portions of the inner face of core 36. Finally, covering 38' has an outwardly extending lip 50 which extends substantially the length of the base of the seal. The outer end of this side of the seal abuts the underside of bracket 20 stem 24 and the inner face of the lower portion of crossarm 22. This side of the seal then further acts a stop for gate 16.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A gravity outlet for use on a railcar for discharge of lading from the car comprising:

a plurality of sheets of material connected together to form sidewalls of said outlet and to define an opening at a lower end thereof through which lading discharges;

valve means for opening and closing said outlet and including a gate located beneath said sidewalls of said outlet and slidably movable across said opening to open and close said outlet;

first and second support means positioned on opposite sides of said outlet beneath said outlet for supporting said gate;

stop means positioned adjacent an outer end of one of said support means to limit movement of said gate;

seal means for sealing said outlet to prevent loss of lading, said seal means extending completely around the periphery of said opening, said seal means being installed between said outlet and said support means with one side of said seal means being positioned between one sidewall of said outlet and an upper surface of said gate to press down on said gate, and an opposite side of said seal means being contacted by an inner end of said gate to press said seal means against said stop means, said inner end of said gate being contoured and said opposite side of said seal means being correspondingly contoured for contact with said inner end, said seal means being a multi-ply seal having an inner core of a spring-like material, and an outer covering of a wear resistance material, said outer covering being contacted by said gate as it moves between positions, and said inner core forcing said outer covering into contact with said gate to effect a seal between said outer covering and said gate; and a first and L-shaped bracket attached to a underside of a first sheet of material forming one of said sidewalls, and a second and T-shaped bracket attached to a second sheet of material forming a second and opposite sidewall, said one side of said seal being positioned against said first bracket and said upper face of said gate and said second bracket forming said stop means.

2. The outlet of claim 1 wherein said outer covering fits on said one side of said seal, said side of said seal contacting said upper surface of said gate, and on said opposite contoured side of said seal.

3. The outlet of claim 2 wherein said one side of said seal pressing down on said gate is generally rectangular in cross-section.

4. The outlet of claim 2 wherein said outer covering is a wear resistant rubber material.

5. The outlet of claim 1 wherein said first bracket has a groove formed therein in which an upper face of said one side of said seal is fitted.

* * * * *